US005906112A

United States Patent [19]

Amin et al.

[11] Patent Number: 5,906,112

[45] Date of Patent: May 25, 1999

[54] ACCUMULATOR FOR AN AIR CONDITIONING SYSTEM

[75] Inventors: Jayendra Jayantibhai Amin, Commerce Township; Gary D. Bramos, New Baltimore; Jeffrey S. Schneider, Canton; Orthell LaVount Adams, Ypsilanti, all of Mich.

[73] Assignee: Ford Motor Company, Dearborn, Mich.

[21] Appl. No.: 08/989,410

[22] Filed: Dec. 12, 1997

[51] Int. Cl.[6] ..... F25B 43/00

[52] U.S. Cl. ..... 62/503; 62/471

[58] Field of Search ..... 62/471, 474, 503, 62/509, 512

[56] References Cited

U.S. PATENT DOCUMENTS

| | | | |
|---|---|---|---|
| 2,813,404 | 8/1957 | Hirsch . | |
| 4,182,136 | 1/1980 | Morse | 62/503 |
| 4,474,034 | 10/1984 | Avery, Jr. | 62/503 |
| 4,509,340 | 4/1985 | Mullally et al. | 62/474 |
| 5,179,844 | 1/1993 | Lyman et al. | 62/503 |
| 5,419,157 | 5/1995 | Kiblawi et al. | 62/503 |
| 5,515,696 | 5/1996 | Hutchison | 62/509 |
| 5,660,058 | 8/1997 | Harris et al. | 62/471 |

FOREIGN PATENT DOCUMENTS

| | | |
|---|---|---|
| 94-590 | 11/1983 | European Pat. Off. . |
| 06281297 | 10/1994 | Japan . |
| 06281298 | 10/1994 | Japan . |

*Primary Examiner*—William Doerrler
*Attorney, Agent, or Firm*—Raymond L. Coppiellie

[57] ABSTRACT

There is disclosed herein an accumulator for an air conditioning system. The accumulator includes a sump for collecting oil to be provided to the air conditioning compressor. There is also disclosed an outlet tube in the accumulator, the tube having a flange opening and a necked-down portion a predetermined distance from the flange opening.

9 Claims, 1 Drawing Sheet

ACCUMULATOR FOR AN AIR CONDITIONING SYSTEM

BACKGROUND OF THE INVENTION

1. Field of the Invention

The present invention relates generally to an accumulator for an air conditioning system . More particularly, the present invention relates to an accumulator which increases refrigerant flow velocity and improves oil supply to the compressor.

2. Disclosure Information

An air conditioning system conventionally includes a compressor, a condenser, a refrigerant control device, an evaporator and an accumulator arranged as a refrigerant circuit. The compressor compresses the refrigerant for delivery to the condenser, where the state of the refrigerant changes from gaseous to liquid. The liquid refrigerant then passes through the refrigerant control device to the evaporator, where an air blower circulates air over the evaporator to provide cooled air to the vehicle passenger compartment. The resulting heat transfer from passing the ambient air over the evaporator causes the refrigerant to mostly change state from a liquid to a gas, although some liquid does remain.

Liquid and gaseous refrigerant then pass from the evaporator to the accumulator. The accumulator separates the liquid refrigerant from the gaseous refrigerant, allowing only gaseous refrigerant to return to the compressor. The residual liquid refrigerant eventually turns to a gaseous state and is then returned to the compressor. The accumulator also recovers lubricating oil contained in the refrigerant and returns a metered amount of the oil to the inlet side of the compressor.

The accumulator normally comprises an upright cylindrical housing with an inlet opening formed therein and an outlet tube having its mouth in the upper interior region of the accumulator. Refrigerant from the evaporator is introduced into the accumulator through the inlet opening, which may be in the top or in the side of the accumulator housing. The liquid refrigerant settles to the bottom of the accumulator. Gaseous refrigerant rises to the top of the accumulator, where suction by the compressor draws the gaseous refrigerant through the outlet tube. Typically, the outlet tube is a J-shaped tube having an oil inlet at the bottom or curved part of the J-shaped tube. The gaseous refrigerant enters the top opening of the tube and travels along its complete length before exiting the accumulator. Manufacturing a J-shaped tube is labor intensive and complex.

During a low charge/low oil system condition in the refrigerant circuit, the compressor can be damaged if the volume of oil returned to the compressor is too low. Oil is used to lubricate the moving members within the compressor. Typically, the outlet tube of the accumulator includes the metering or oil return orifice located at the bottom of the outlet tube adjacent the bottom of the accumulator housing for drawing oil pooled along the bottom of the accumulator into the tube which passes the oil to the compressor. Flow of the refrigerant through the outlet tube draws the oil from the oil return orifice and carries it to the compressor. Higher flow velocities increase the drawing of the oil into the outlet tube.

Therefore it would be advantageous to provide an accumulator which provides increased flow velocity of refrigerant through the outlet tube to increase the amount of oil returned to the compressor.

It is an object of the present invention to provide an accumulator which is cheaper and easier to manufacture and which increases the flow velocity of the refrigerant leaving the accumulator.

SUMMARY OF THE INVENTION

It is a further object of the present invention to provide an accumulator which insures oil supply to the air conditioning compressor. The present invention provides a suction accumulator for an air conditioning system, comprising a housing comprising a generally cylindrical, vertical wall having an upper portion including a generally circular top, an inlet opening and an outlet opening, and a lower portion having a generally circular base. An oil collecting sump is disposed at the radially defined center of the base of the lower portion of the housing.

The accumulator further includes an inlet tube disposed through the inlet opening in the housing for introducing a two-phase refrigerant into the housing and an outlet tube spaced apart from the inlet tube and having a first end contained within the housing and a second end disposed through the outlet opening in the upper portion of the wall of the housing and in fluid communication with a compressor of the refrigerant system. The first end of the outlet tube is generally bell-shaped and has a diameter at least 65% of the diameter of the housing. The bell-shaped end is disposed proximate the top of the housing and includes a tubular portion extending through the outlet opening of the housing and a transition portion between the bell-shaped portion and the tubular portion. An oil return line extends from the base in the lower housing portion and into the tubular portion of the outlet tube a predetermined distance, the oil return line having a bend portion along its length.

It is an advantage of the present invention that manufacturing such an accumulator is less complex and expensive since fewer components are needed. It is also an advantage that a greater open area within the accumulator housing is available, allowing more packagability of the accumulator.

These and other objects, features and advantages of the present invention will become apparent from the drawings, detailed description and claims which follow.

DETAILED DESCRIPTION OF THE PREFERRED EMBODIMENTS

Figure 1:
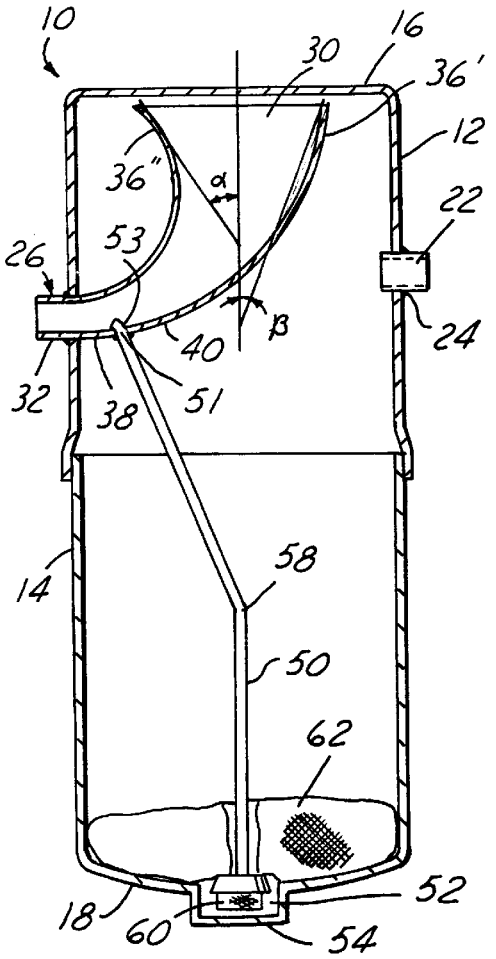
FIG. 1 is a cross-sectional view of an accumulator structured in accord with the principles of the present invention.
Figure 2:
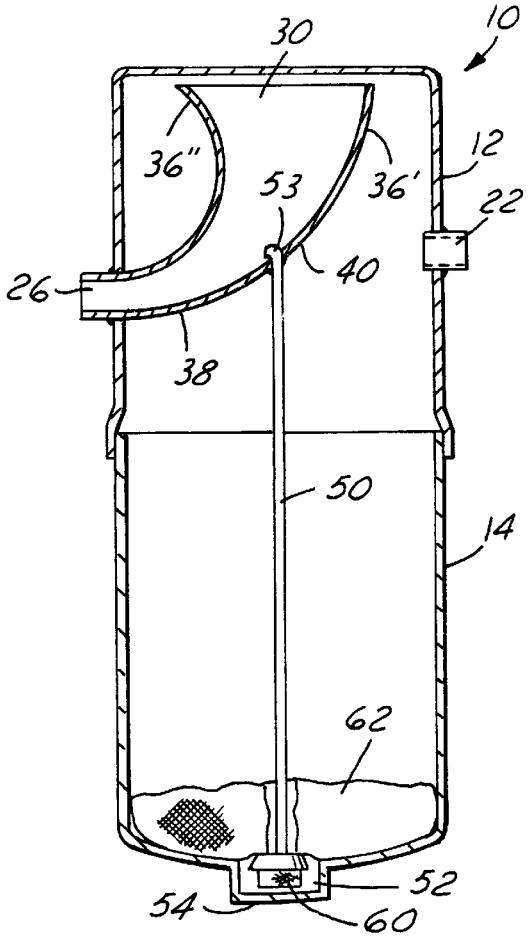
FIG. 2 is a cross-sectional view of an alternative embodiment of an accumulator of the present invention.
Figure 3:
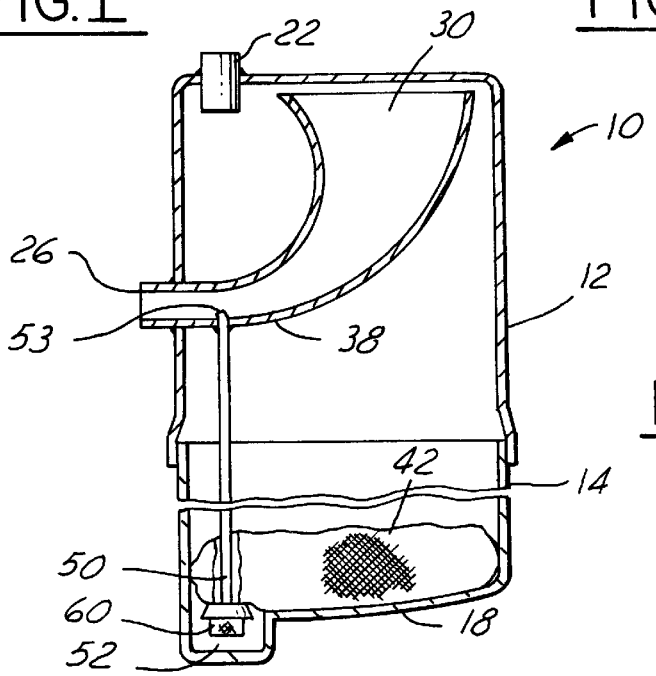
FIG. 3 is a cross-sectional view of an alternative embodiment of an accumulator of the present invention.

Referring now to the drawings, FIGS. 1 and 2 show two embodiments of accumulators of the present invention for use in an automotive air conditioning system of the type known in the art and such as disclosed in U.S. Pat. No. 4,474,035, the disclosure of which at column 2, lines 30-column 4, line 10 is hereby incorporated by reference. As is well understood to one of ordinary skill in the art, but not shown in the drawings herein, an air conditioning system includes a compressor, the output of which flows to a condenser through a liquid line, through a refrigerant control device to an evaporator and then to an accumulator. From the accumulator, the refrigerant is returned to the compressor.

As is show in FIG. 1, the accumulator of the present invention includes a generally cylindrical, vertically disposed housing 10 comprising an upper portion 12 an a lower portion 14. The housing 10 may be an integral, one-piece member or may be formed from two separate, can-shaped members joined together at a weld seam. The upper portion 12 of the accumulator is closed by an upper wall 16 and the lower portion 14 of the accumulator is closed by a lower wall 18. An inlet tube 22 is received within an opening formed through the sidewall of the housing 10 in the upper portion 12 thereof and is brazed at 24. An outlet tube 26 of the present invention extends through another opening in the sidewall of the upper portion 12 of the housing 10 and it too is brazed.

The outlet tube 26 extends through the housing 10, preferably through the vertical wall of the upper portion 12. The outlet tube 26 is spaced apart from the inlet tube 22 and includes a first end 30 contained within the housing 10 and a second end 32 disposed through the upper portion 12 of the housing 10. The outlet tube 26 fluidly communicates with the compressor to provide the compressor with gaseous refrigerant and a small quantity of oil for lubrication. The first end 30 of the outlet tube is generally bell-shaped 36 and has a diameter at least 65% of the diameter of the housing 10. In the preferred embodiment, the first end of the outlet tube has a diameter approximately equal to 85% of the diameter of the housing 10. The bell-shaped first end 30 is disposed very close to the top of the housing, preferably within 2.0 mm and 4.0 mm of it. This assures that only gaseous refrigerant enters the outlet tube. The bell-shaped portion 36 defines an asymmetric cone in that one portion of the cone is disposed at a greater angle than a different portion of the cone. As shown in FIG. 1, if a straight vertical line is drawn from the center of the bell-shaped portion, the side 36' is disposed at an angle β which is less than the angle a for side 36".

The outlet tube 26 also includes a tubular portion 38 extending through the sidewall of the housing 10 and a transition portion 40 between the bell-shaped portion 36 and the tubular portion 38. With an outlet tube of this type, the need for a domed plate within the accumulator is obviated, thus saving cost and complexity in the manufacture of the accumulator.

The accumulator also includes an oil return line 50. Oil return line 50 extends from an oil collecting sump 52 disposed in the base 54 of the housing 10 to the tubular portion 38 of the outlet tube 26. As shown in FIG. 1, the exit end 51 of the oil return line 50 is placed within approximately 0.7 in and preferably 0.5 in from the accumulator sidewall. It has been found that pressure drop with the oil return line placed 0.5 in from the sidewall is higher between the exit of the inlet tube 22 and the entrance of the bell-shaped vapor return cone 36 and is lower through the vapor return outlet tube 26 than if the oil return line is placed further away from the sidewall.

The oil return line 50 extends into the tubular portion 38 of the outlet tube a distance of approximately 0.5 in. This extension 53 provides an increased amount of oil into the refrigerant returning to the compressor. It has been found that the pressure drop of the flow through the oil return line 50 with this extension 53 is significantly higher than if the extension is not present. It should be noted that the pressure drop (or pressure head) of the flow through the oil return line 50 is the only driving power for the oil returning back to the system through the line 50. The higher the pressure head, the higher the flow rate in the oil return line. Another reason for this is that the oil is drawn up the oil return line 50 by the increased velocity flow of the refrigerant provided by the bell-shaped design of the outlet tube. The drawn-up oil is deposited directly into the refrigerant flow by the extension 53, therefore more oil is returned to the compressor. It has been found that if the extension 53 is not provided, the oil drawn up the oil return tube 50 attaches to the bottom of the tubular portion of the outlet tube and does not return to the compressor as efficiently as possible.

The oil collecting sump is disposed at the radially defined center of the base 54 of the housing. Because of this, the oil return line 50 necessarily includes a bend portion 58. As explained above, it has been determined that the accumulator of the present design is most efficient when the oil return line 50 fluidly communicates with the tubular portion 38 of the outlet tube. Alternatively, the oil return line can be connected to the transition portion 40 or the bell-shaped portion 36 of the outlet tube 26 as shown in FIG. 2. The oil return line 50 provides oil from the sump 52 which is combined with gaseous refrigerant and passed to the compressor. The oil provides lubricity to the moving internal parts of the compressor. A filter assembly 60 may be secured to the end of the oil return line disposed in the sump 52 to prevent any contaminants in the oil from entering the compressor. Alternatively, the oil sump can be placed offset from the radial center of the base of the accumulator housing. A quantity of desiccant material 62 is disposed in the lower portion of the housing 10 as is well known.

It should be apparent that many variations and modifications of the present invention are possible without departing from the spirit and scope of the present invention. For example, the present invention has been described with reference to an air conditioning system of an automotive vehicle. However, the accumulator of the present invention can be used in any type of air conditioning system having a compressor. It is the following claims, including all equivalents which define the scope of the present invention.

What is claimed is:

1. A suction accumulator for use in an air conditioning system, comprising:

a housing comprising a generally cylindrical, vertical wall having an upper portion including a generally circular top, an inlet opening and an outlet opening, and a lower portion having a generally circular base, an inlet tube disposed through said inlet opening in said housing for introducing a two-phase refrigerant into said housing;

an outlet tube spaced apart from said inlet tube and having a first end contained within said housing and a second end disposed through said outlet opening in said upper portion of said wall of said housing and in fluid communication with a compressor, said first end being generally bell-shaped and having a first surface and a second surface defining an asymmetric cone through which said vapor flows, said first end being disposed proximate the top of said housing, said outlet tube having a tubular portion extending through said outlet opening and a transition portion between said bell-shaped portion and said tubular portion, said inlet tube being spaced apart from said outlet tube; and an oil return line extending from said base in said lower housing portion to said tubular portion of said outlet tube.

2. An accumulator according to claim 1, wherein the diameter of said bell-shaped first end of said outlet tube is at least 65% of the diameter of said housing.

3. An accumulator according to claim 1, wherein said first end of said outlet tube is spaced from the top of said housing by less than 4.0 mm.

4. An accumulator according to claim 1, wherein said base of said lower portion includes an oil collecting sump disposed at the radially defined center portion of said base.

5. An accumulator according to claim 4, wherein said one end of said oil return line is disposed in said oil collecting sump.

6. An accumulator according to claim 4, wherein said oil return line extends from said oil collecting sump to said transition portion of said outlet tube.

7. An accumulator according to claim 6, wherein one end of said oil return line extends into said outlet tube a predetermined distance.

8. An accumulator according to claim 4, wherein one end of said oil return line is disposed in said oil collecting sump and the other end extends through said outlet tube by no more than 0.05 in and is disposed from said housing by less than 0.7 in.

9. A suction accumulator for use in an air conditioning system, comprising:

a housing comprising a generally cylindrical, vertical wall having an upper portion including a generally circular top, an inlet opening and an outlet opening, and a lower portion having a generally circular base, an oil collecting sump disposed at the radially defined center of the base of the lower portion of the housing;

an inlet tube disposed through said inlet opening in said housing for introducing a two-phase refrigerant into said housing;

an outlet tube spaced apart from said inlet tube and having a first end contained within said housing and a second end disposed through said outlet opening in said upper portion of said wall of said housing and in fluid communication with a compressor, said first end being generally bell-shaped and having a diameter greater than 75% of the diameter of the housing and disposed proximate the top of said housing, said first end having a first surface and a second surface defining an asymmetric cone through which said vapor flows, said outlet tube having a tubular portion extending through said outlet opening and a transition portion between said bell-shaped portion and said tubular portion, said inlet tube being spaced apart from said outlet tube; and an oil return line extending from said oil collecting sump in said base in said lower housing portion into said tubular portion of said outlet tube by approximately 0.5 in, said oil return line having a bend portion along its length so as to be disposed within 0.5 in from the housing vertical wall.

* * * * *